US006027233A

United States Patent [19]

Chen

[11] Patent Number: 6,027,233

[45] Date of Patent: Feb. 22, 2000

[54] COUNTERBALANCED LAMP HAVING A RESILIENTLY BOWED SPRING LEVER

[76] Inventor: Frank Chen, 8F-6, No. 100, Sec. 2, Hoping East Road, Taipei Hsien, Taiwan

[21] Appl. No.: 08/858,999

[22] Filed: May 16, 1997

[51] Int. Cl.[7] ..... F21V 21/18

[52] U.S. Cl. ..... 362/402; 248/280.11; 248/284.1; 248/123.11

[58] Field of Search ..... 248/280.11, 284.1, 248/123.11, 584, 592, 292.11, 292.13; 362/401, 402

[56] References Cited

U.S. PATENT DOCUMENTS

| | | | |
|---|---|---|---|
| 4,703,909 | 11/1987 | Dayton et al. | 248/280.11 |
| 4,974,135 | 11/1990 | Wen-tsung | 362/401 X |
| 5,108,061 | 4/1992 | Vlasak | 248/280.11 X |
| 5,158,361 | 10/1992 | Huang | 362/401 X |
| 5,333,103 | 7/1994 | Cvek | 362/402 X |

*Primary Examiner*—Ramon O. Ramirez
*Assistant Examiner*—Stephen S. Wentsler
*Attorney, Agent, or Firm*—Rosenberg, Klein & Lee

[57] ABSTRACT

The invention concerns a form of lighting decoration hanger structure. It refers especially to a bow form such as those supporting structures used in fishing rod as an arm of uphold. It includes the light hood, the supporting arm, spring lever and its foundation. The axis of the light hood is fixed on the upper end of the supporting arm. The foundation has a protruding fixed base. The lower end of the supporting arm is connected to the fixed base. The main point is that the spring lever located between the light hood and the fixed base. The spring lever has, on its upper and lower end, a ring-like circle and a transition spring. There is also a base lock situated at the fixed base of the foundation. This base lock has a fixed lock on it. The ring-like circle on the upper end of the spring lever is capped on the connector piece between the connector of the light hood and the supporting arm or it could be connected to the upper end of the supporting arm. The transition spring at the lower end of the spring lever is capped on the base lock of the fixed base and is combined with a fixed slot at the foundation so that the spring lever forms a bow-like supporting structure. The aforementioned structure, during movements of the supporting arm, could be pulled to a fix by use of the spring lever; this forms bow-like structure of support as that of the fishing rod. This structure is sufficient in supporting the light hood in limited area in any position pleased. In addition, when the supporting arm moves, the spring lever will display different forms due to principals of dynamics. All these contribute to the variety of external forms which the whole set of light displays.

5 Claims, 7 Drawing Sheets

COUNTERBALANCED LAMP HAVING A RESILIENTLY BOWED SPRING LEVER

FIELD OF THE INVENTION

The invention concerns a form of lighting decoration hanger structure. It especially refers to one which could be pulled by a spring lever to form a bow-like supporting structure the same as that of a fishing rod. This structure is able to support the light hood in a limited area in any position pleased. In addition, when the supporting arm moves, the spring lever displays different forms so as to let the entire set of light display a variety of external forms.

DESCRIPTION OF THE PRIOR ART

Accordingly, with the increase of living standards, lights and lighting decoration are gradually being emphasized by people. The coordination of appropriate lighting decorations in the interior decorations has both practical purposes and purpose of beauty. Those table lamp decorations which we are familiar with, utilizes screw like elastic springs to hold onto the supporting arm so that the light hood which is located at the top end of the supporting arm will not fall to the ground due to gravitational pull; this balances the pull of gravity and the light hood could perform appropriate movements. However, such design which exposes the spring lever will create a feeling of non-conformity so as to not form one single entity with the lighting decoration; this seriously undermines the exterior view of the lighting decoration. In addition, the exterior of the spring lever does not have much change and so lack attraction to its potential user.

Therefore, one may deduce from the information above that the usual lighting decoration, in its practical use, apparently has its deficiencies and is quite impractical. There is room for change.

So, the inventor, I, felt that changes could be made to improve the deficiencies. Researches and study were done in the area of usage of the principal of dynamics. A new design is proposed which is this invention with improvements on the aforementioned deficiencies.

SUMMARY OF THE INVENTION

The main purpose of this invention is "to provide a structure of lighting decoration support that includes the light hood, the supporting arm, the spring lever and its foundation. Its main feature is that there is a spring lever between the light hood and the fixed base. The upper and lower end has form of ring-like circle and a transition spring. The fixed base of the foundation has a pair of base lock on it. The base lock has a fixed lock on it. The ring-like circle on the upper end of the spring lever is capped on the connector of the light hood and the connecting piece of the supporting arm; it could also be connected to the upper end of the supporting arm. The transition spring at the lower end of the spring lever is capped on the fixed lock of the fixed base; it is also combined with a fixed slot so that the spring lever forms a bow-like supporting structure. During movements of the supporting arm, the spring lever may pull it to a fix and thus form a bow-like structure such as that of a fishing rod. This structure is sufficient to support the light hood into a fixed position in a limited area. In addition, when the supporting arm moves, the spring lever displays different forms so as to let the entire set of light display a variety of external forms.

BRIEF DESCRIPTION OF THE DRAWINGS

In order to achieve the aforementioned purpose and structure, this invention has its design and functions described in detail with the use of illustrative figures as follows.

Simple Description of Illustrative Figures.

BRIEF DESCRIPTION OF NUMERICALS

Figure 1:
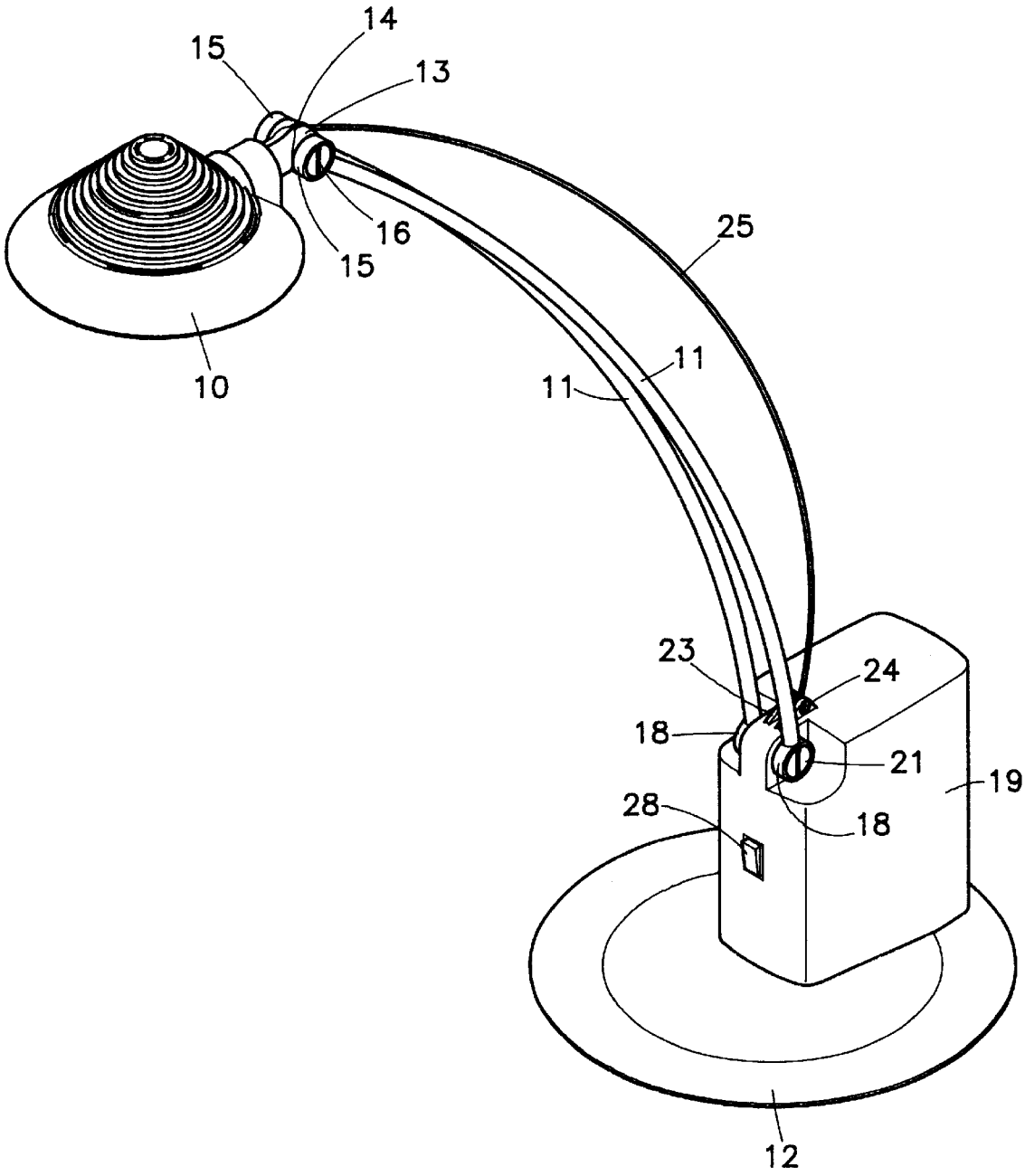
FIG. 1 This is the combination 3-D Diagram of the invention.
Figure 2:
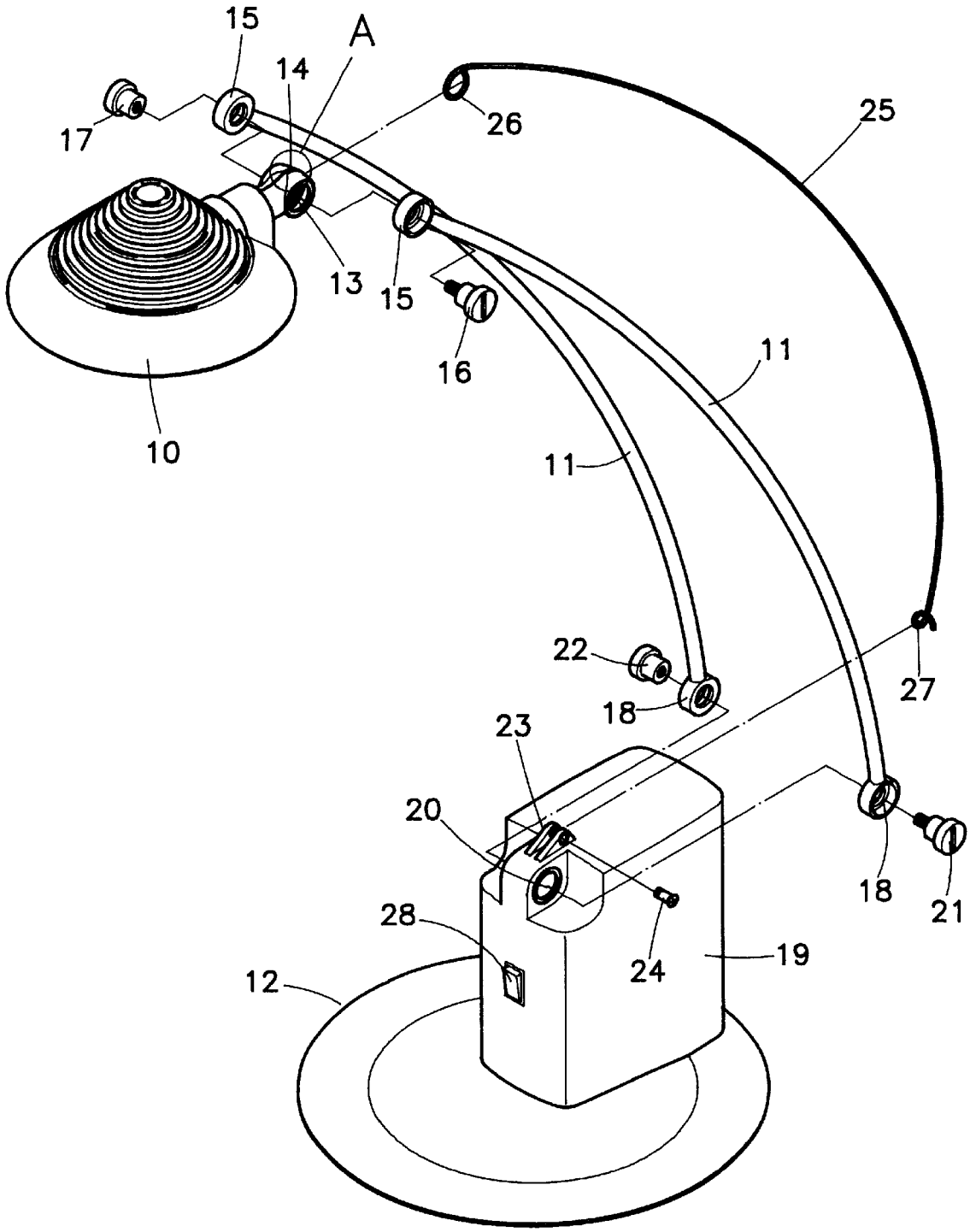
FIG. 2 This is the dissected 3-D Diagram of the invention.
Figure 2A:
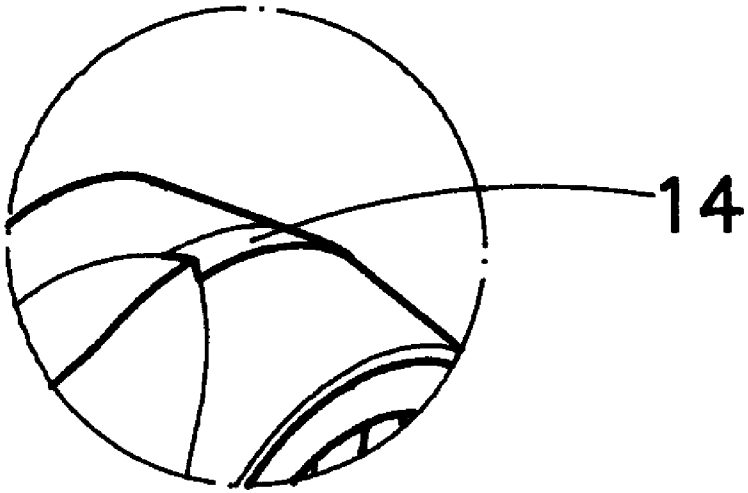
FIG. 2A This is the enlarged dissected view of the open gutter of the upper connector piece illustrated in view "A" of FIG. 2.
Figure 3:
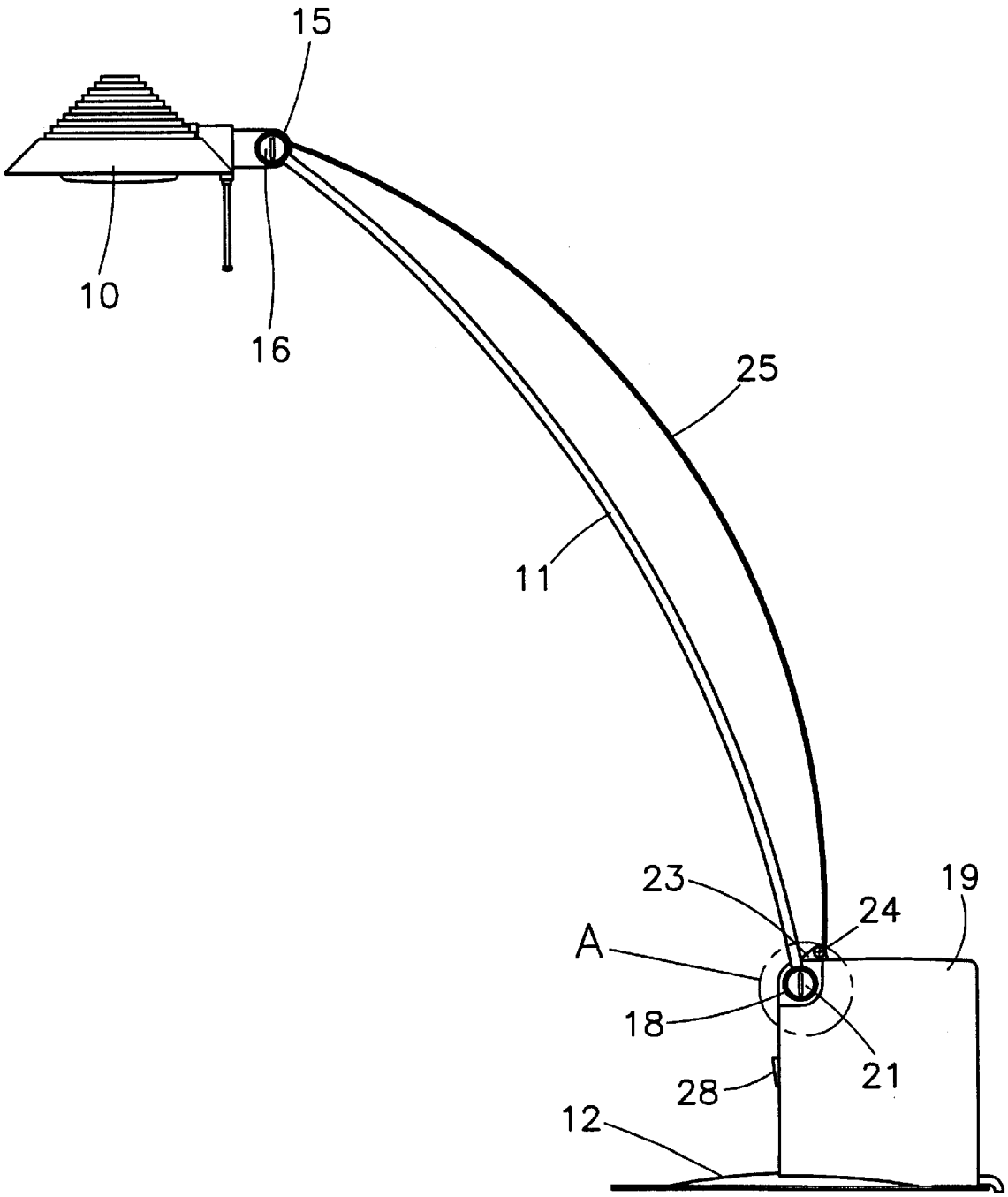
FIG. 3 This is the side view of the invention.
Figure 3A:
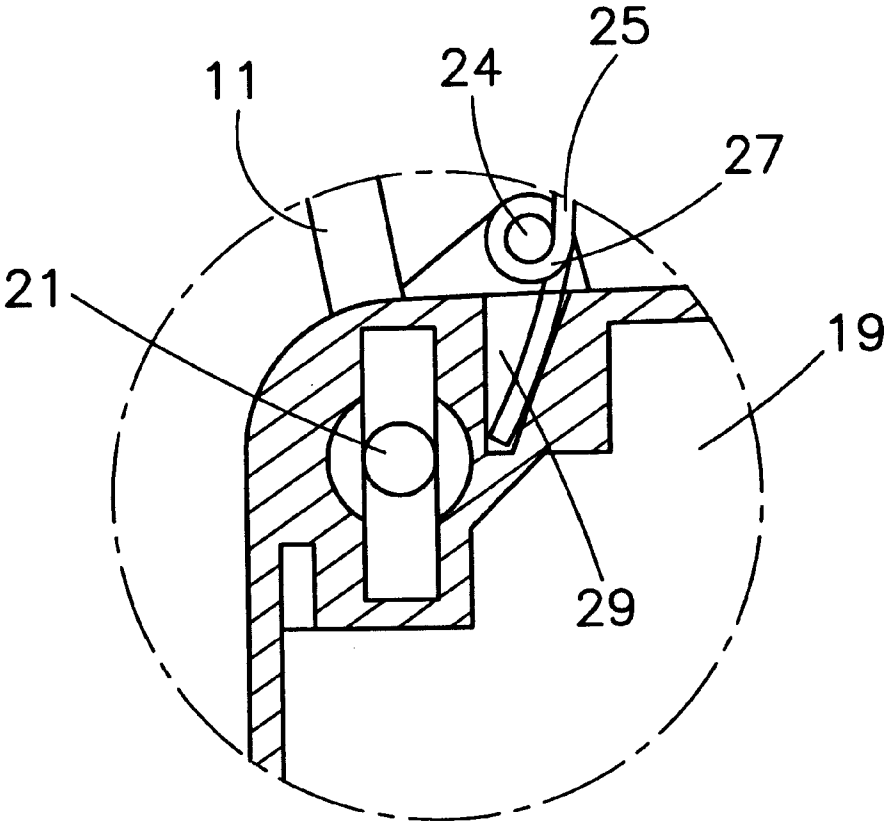
FIG. 3A This is the enlarged view of the connection of the supporting arm and the spring lever to the fixed base illustrated in view "A" of FIG. 3.

Explanation of symbols:

| | |
|---|---|
| 10 Light Hood | 11 Supporting Arm |
| 12 Foundation | 13 Upper Connector Piece |
| 14 Open Gutter | 15 Upper Connector Piece |
| 16 Upper Link Piece | 17 Upper Link Piece |
| 18 Lower Connector Piece | 19 Fixed Base |
| 20 Lower Connector Piece | 21 Lower Link Piece |
| 22 Lower Link Piece | 23 Base Lock |
| 24 Fixed Lock | 25 Spring Lever |
| 26 Ring-like Circle | 27 Transition Spring |
| 28 Power Switch | 29 Fixed Slot |
| 30 Connector Piece | |

DETAILED DESCRIPTION OF PREFERRED EMBODIMENT

Please refer to the first, second and the third figures which are the combination 3-D diagram, the dissected 3-D diagram and the side view of the invention. This invention is an improvement of the supporting structure of the lighting decoration. This invention includes: one Light Hood (diagram symbol: 10), two Supporting Arms (diagram symbol: 11), one Spring Lever (diagram symbol: 25) and one Foundation (diagram symbol: 12). The Light Hood (diagram symbol: 10) has an internally empty tube-shaped container, the Upper Connector Piece (diagram symbol 13). This Upper Connector Piece (diagram symbol 13) has an Open Gutter (diagram symbol 14) which passes through to its internals.

The two Supporting Arms (diagram symbol 11) has on the top end of it, each, an internally empty tube-shaped container, the Upper Connector Piece (diagram symbol 15) The two Upper Link Pieces (diagram symbol 16 and 17) is connected to the Upper Connector Piece (diagram symbol 15) of the two Supporting Arms (diagram symbol 11) and to the Upper Connector Piece (diagram symbol 13) of the Light Hood (diagram symbol 10). In addition, the two Upper Link Pieces (diagram symbol 16 and 17) is connected as one entity so that the Upper Connector Piece (diagram symbol: 15) and the Light Hood (diagram symbol 10) of the two Supporting Arms (diagram symbol 11) and the Upper Connector Piece (diagram symbol 13) of the Light Hood (diagram symbol 10) may be connected as one entity to the two Upper Link Pieces (diagram symbol 16 and 17). This way the Light Hood (diagram symbol 10) may be connected to the Supporting Arm (diagram symbol 11). The two Supporting Arms (11) has, each, at its lower end an internally empty tube-shaped container, the Lower Connector Piece (18) to facilitate its connection to the Foundation (12).

The Foundation (12) has a protruding Fixed Base (19); the Fixed Base (19) has a Lower Connector Piece (20); they may utilize the Lower Link Pieces (21 and 22) to connect to the Lower Connector Piece (18) of the two Supporting Arms (11) as well as the Lower Connector Piece (20) of the Fixed Base (19); in addition, the two Lower Link Pieces (21 and 22) are screwed into one entity so that the Lower Connector Piece (18) of the two Supporting Arms (11) and the Lower Connector Piece (20) of the Fixed Base (19) may utilize the Lower Link Pieces (21 and 22) to form one entity. This is so that the Lower Connector Pieces of the Supporting Arm (11) may be connected to the Fixed Base (19). This Fixed Base (10) has a Power Switch (28). Its interior has appropriate electrical circuit and conducting wires so as to transmit a 12Volt low voltage electric current to the Supporting Arm (11). Through the Supporting Arm (11) (or its interior conducting wire) electricity is sent to the Light Hood (10). Since the technique of such transmission of electricity is a widely known skill and not within the scope of this patent application, no further details will be pursued here.

Its main feature of this invention is that the Spring Lever (25) is located between the Light Hood (10) and the Fixed Base (19). This Spring Lever (25) is a long slender rod of elasticity. This Spring Lever (25) is longer than the Supporting Arm (11). The upper and lower end of the Spring Lever (25) has the Ring-like Circle (26) and the Transition Spring (27) connected. The Fixed Base (19) of the Foundation (12) has a pair of Base Lock (23) on it. The Base Lock (23) has a Fixed Lock (24) on it. The Fixed Lock (24) on the Fixed Base (19) has at its lower end a Fixed Slot (29). The Ring-like Circle (26) at the upper end of the Spring Lever (25) penetrates the Open Gutter (14) of the Upper Connector Piece (13) of the Light Hood (10) and is capped to the Upper Link Pieces (16 and 17). The Transition Spring (27) at the lower end of the Spring Lever (25) is capped on the Fixed Lock (24) of the Fixed Base (19); the Transition Spring (27) is also combined with a Fixed Slot (29) so that the Spring Lever (25) forms a bow-like supporting structure such as that of a fishing rod, connecting the Light Hood (10) and the Fixed Base (19).

Figure 4:
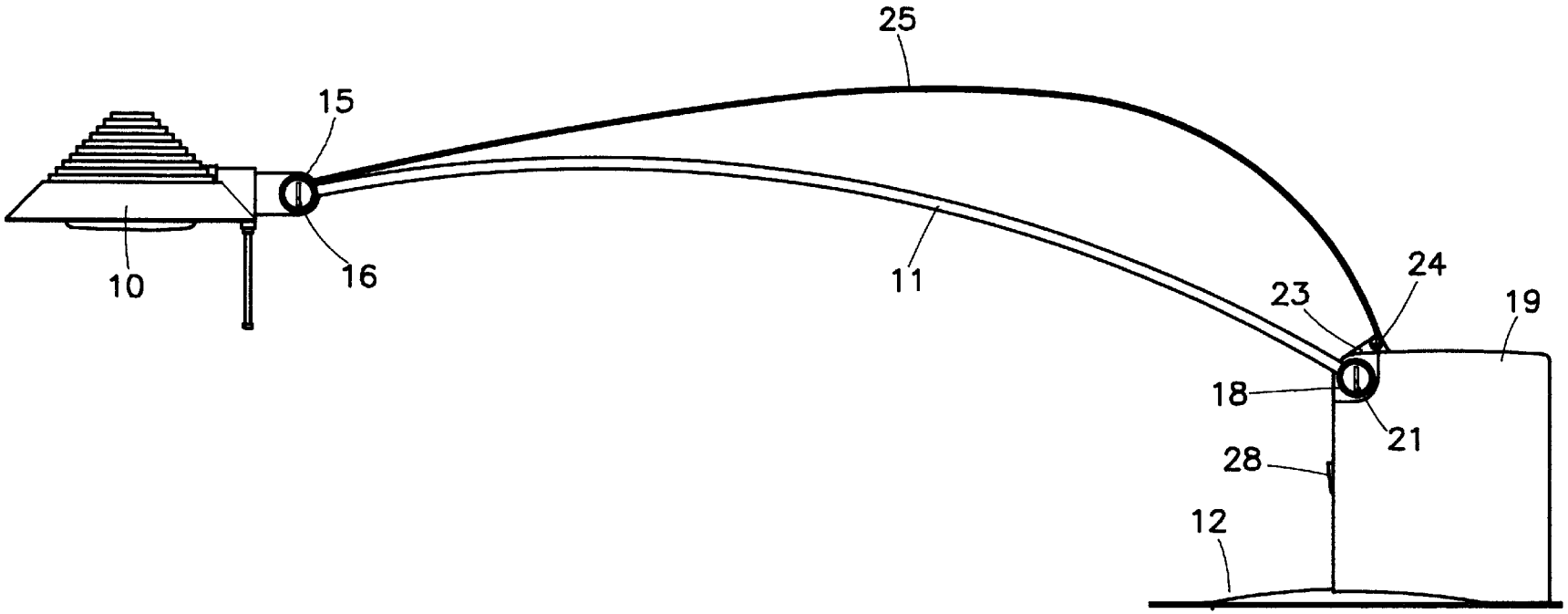
FIG. 4 This is the side view of the invention in another form.

This structure of this device, during movements of the Supporting Arm (11), may utilize the Spring Lever (25) to pull it to a fixed position and thus form a bow-like structure such as that of a fishing rod. This structure is sufficient to support the Light Hood (10) into a fixed position in a limited area. In addition, when the Supporting Arm (11) moves, the Spring Lever (25) displays different forms (as shown in the diagram of FIG. 4) so as to let the entire set of light display a variety of external forms. Both the Spring Lever (25) and the Supporting Arm (11) are long and slender rods. The position of the Spring Lever (25) may be formed into one single entity with the whole set of lighting decoration. There will not be a non-conforming feeling with the lighting decoration.

In addition, the invention's Spring Lever (25) is a long slender rod which will not collect dust; its cleaning is easy and very practical in usage.

Figure 5:
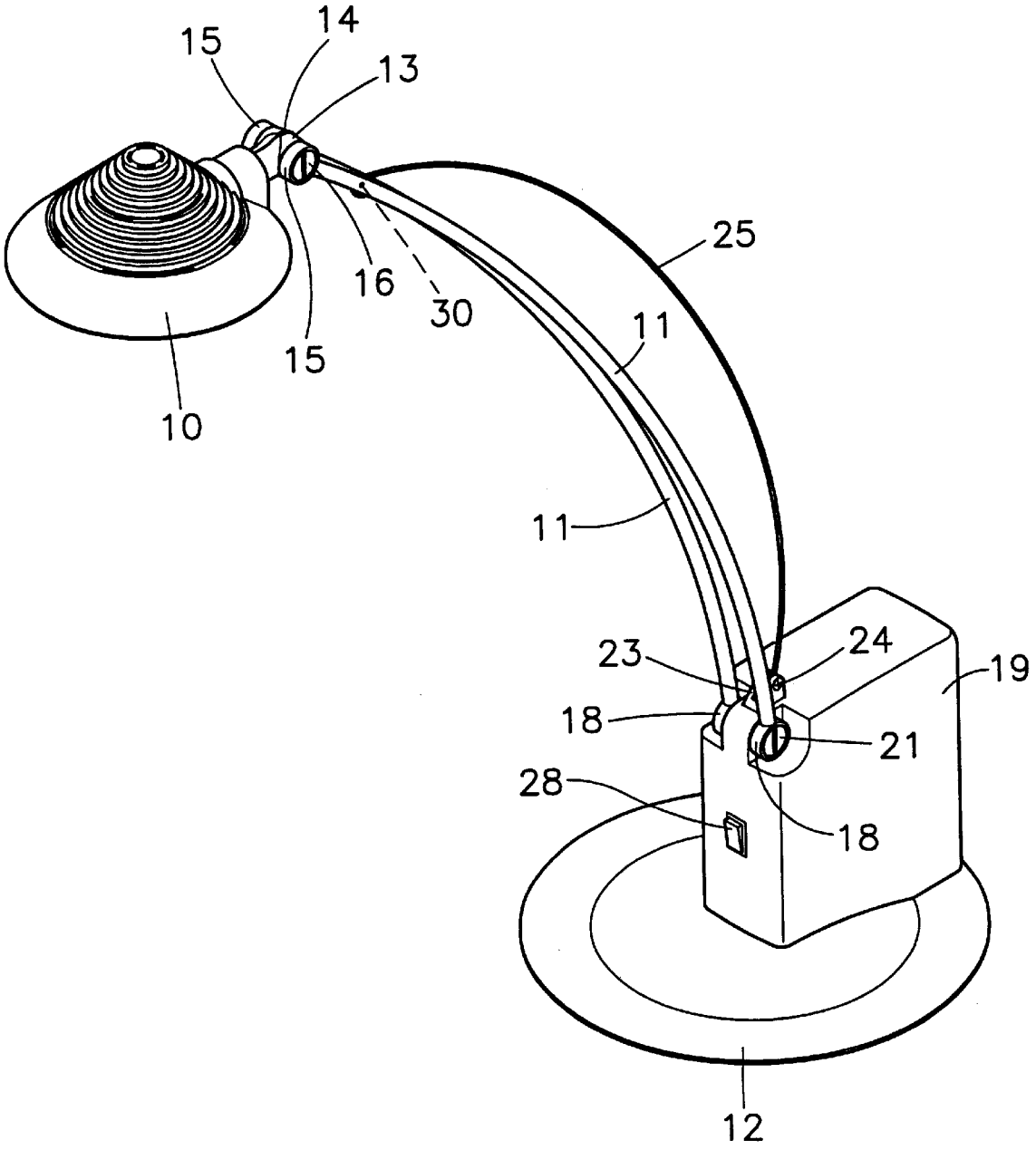
FIG. 5 This is the combination 3-D Diagram of the invention in another example of actual implementation.

Referring to the diagram of FIG. 5, it is the combination 3-D Diagram of the invention in another example of actual implementation. This invention may also have the Ring-like Circle (26) at the upper end of its Spring Lever (25) capped at the Connector Piece (30) of the Supporting Arm (11) so that the Ring-like Circle(26) at the upper end of the Spring Lever (25) may be connected to the upper end of the Supporting Arm (11).

I claim:

1. A reconfigurable lamp comprising:

(a) a base assembly having a fixed slot formed therein;

(b) two supporting arms pivotally coupled to and extending from said base assembly, each of said two supporting arms terminating at an upper end portion;

(c) a light hood assembly coupled to said upper end portions of said supporting arms; and, (d) an elongate spring lever extending between said base assembly and said upper end portions of said supporting arms in resiliently bowed manner, said spring lever having a first end portion engaging said fixed slot of said base assembly and a second end portion pivotally coupled to said upper end portions of said supporting arms;

whereby said light hood assembly is adjustably suspended from said base assembly.

2. The reconfigurable lamp as recited in claim 1 wherein said light hood assembly is pivotally coupled to said upper end portions of said supporting arms.

3. A reconfigurable lamp comprising:

(a) a base assembly having a fixed slot formed therein;

(b) a pair of supporting arms pivotally coupled to and extending from said base assembly, said supporting arms each terminating at an upper end portion;

(c) a light hood assembly coupled to said upper end portions of said supporting arms; and, (d) an elongate spring lever having a greater length than said supporting arms coupled to said base assembly and said upper end portions of said supporting arms to extend therebetween in resiliently bowed manner, said spring lever having formed at opposing ends thereof a transition spring and a ring loop, said transition spring securely engaging said fixed slot of said base assembly, said ring loop being pivotally coupled to said upper end portions of said supporting arms;

whereby said light hood assembly is adjustably suspended from said base assembly.

4. The reconfigurable lamp as recited in claim 4 wherein said light hood assembly is pivotally coupled to said upper end portions of said supporting arms.

5. The reconfigurable lamp as recited in claim 4 wherein said transition spring includes a looped section and a terminal section extending therefrom, said looped section being pivotally coupled to said base assembly, said terminal section being anchored within said fixed slot of said base assembly.

* * * * *